United States Patent [19]

Bui-Hai

[11] Patent Number: 4,546,359

[45] Date of Patent: Oct. 8, 1985

[54] ANTENNA WITH A POLARIZATION ROTATOR IN WAVEGUIDE FEED

[75] Inventor: Nhu Bui-Hai, Paris, France

[73] Assignee: Thomson CSF, Paris, France

[21] Appl. No.: 362,520

[22] Filed: Mar. 26, 1982

[30] Foreign Application Priority Data

Mar. 31, 1981 [FR] France ..... 81 06431

[51] Int. Cl.[4] ..... H01Q 19/13; H01P 1/16

[52] U.S. Cl. ..... 343/781 R; 333/21 A

[58] Field of Search ..... 333/21 A; 343/756, 781 R

[56] References Cited

U.S. PATENT DOCUMENTS 2,996,714 8/1961 Harris ..... 343/756
3,076,188 1/1963 Schneider ..... 343/756
4,375,052 2/1983 Anderson ..... 333/21 A

FOREIGN PATENT DOCUMENTS 820324 9/1959 United Kingdom ..... 333/21 A

*Primary Examiner*—Eli Lieberman
*Attorney, Agent, or Firm*—Cushman, Darby & Cushman

[57] ABSTRACT

An antenna is provided equipped with a device which rotates the direction of the rectilinear polarization of a wave transmitted to a receiver (or transmitted by a transmitter) associated with the antenna, with respect to this same wave such as it is received by the antenna (or transmitted by the antenna). The device is formed from a square cross-section wavequide which is twisted in steps and which steps may be adjustable and which is twist guide inserted in the primary source of the antenna, between the horn of the antenna and the receiving (or transmitting) means associated with the antenna.

1 Claim, 7 Drawing Figures

ANTENNA WITH A POLARIZATION ROTATOR IN WAVEGUIDE FEED

BACKGROUND OF THE INVENTION

The present invention relates to an antenna associated with a receiver or transmitter, for working with linearly polarized waves and comprising a device for transposing the direction of the linear polarization of the waves received by the receiver or transmitted by the transmitter.

The directional adjustment of the linear polarization received from an antenna by a receiver associated with the antenna is required in some cases. For example, in the case of land-based stations, the same vertically polarized wave transmitted by a satellite is picked up with a direction of its polarity which forms with the vertical an angle which depends, more especially, on the latitude and longitude of the place where this wave is picked up. Similarly, an adjustment is required when an antenna changes satellite for the waves which it receives. Because of the very principle of reciprocity, this is equally true for transmission from, for example, land-based stations.

Transposition devices are known which are formed by equipping the ground reception antenna with a mechanical or electro-mechanical system for adjusting the direction of polarization by causing all or part of the antenna to rotate. These rotations are quite compatible with Cassegrain optical antennae, where it is easy to provide, at the position where the horn is located, i.e. at the top of the main dish reflector, an attachment for causing the assembly formed by the horn and its connections to rotate. On the other hand, with prime focus antennae, the rotation of the primary source (horn+-connections) for adjusting the polarization is practically impossible. In fact, in this case, the primary source is generally rigidly fixed at both ends: at the level of the radiating horn and at the level of the junction between its connections and the receiver(s) associated with the antenna. FIGS. 1 and 2 relating to the following description will show the difficulty in providing, in a prime focus antenna, a mechanical assembly for rotating the horn and its connections about the main axis of the reflector.

The object of the present invention is to provide an antenna equipped with a device for transposing the direction of polarization, both simple and inexpensive, able to be used not only for prime focus antennae but also for Cassegrain optical antennae.

SUMMARY OF THE INVENTION

This is obtained by causing a predetermined rotation of the direction of the linear polarization, directly within the primary source.

According to the invention, there is provided an antenna for working with linearly polarized waves and comprising a primary source and a transposition device for transposing the direction of the linear polarization of the waves passing therethrough and in which the transposition device forms part of the primary source and is formed by a square cross-section waveguide is twisted in steps and which steps may be adjustable, connected in series in the primary source.

BRIEF DESCRIPTION OF THE DRAWINGS

The invention will be better understood and other characteristics will appear from the following description and the accompanying figures which show.

DESCRIPTION OF THE PREFERRED EMBODIMENT

Figure 1:
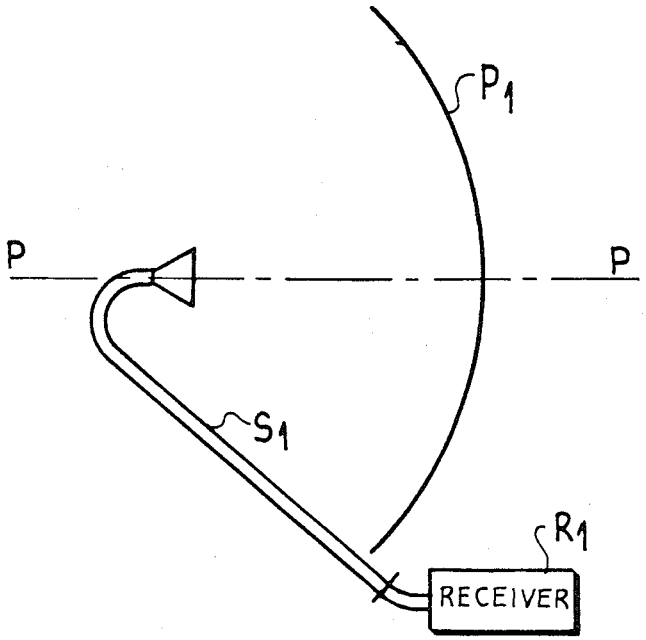
FIG 1 PRIOR ART
FIGS. 1 and 2, antennae of the prior art.
Figure 2:
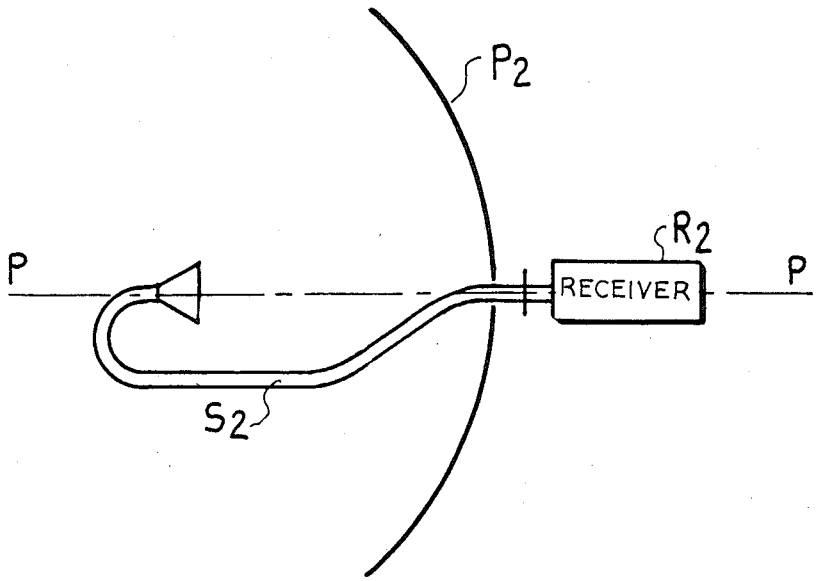
FIG 2 PRIOR ART

FIGS. 1 and 2 show schematically prime focus antennae of the prior art. The antenna of FIG. 1 comprises a reflector $P_1$ associated with a primary "V" source $S_1$ itself connected to a receiver $R_1$; rotation of the primary source about the main axis PP of the reflector requires mechanical means capable of rotating the horn and receiver $R_1$ (or the transmitter in the case of transmission mode operation); such a construction is expensive, heavy and so practically never used. The antenna of FIG. 2 comprises a reflector $P_2$ associated with a primary swan-neck source $S_2$ itself connected to a receiver $R_2$; in this case, the assembly formed by the primary source $S_2$ and receiver $R_2$ (or the transmitter in the case of the transmission operating mode) has both its ends, i.e. its horn and its receiver, merging with the main axis of the reflector $P_2$; but although the rotational control of the primary source and of the receiver is then easier than in the case of an antenna such as shown in FIG. 1, on the other hand the performances of the antenna are inferior because of the large mask created by the primary source because of the presence of the swan neck in the central part of the radiation of reflector $P_2$.

Figure 3:
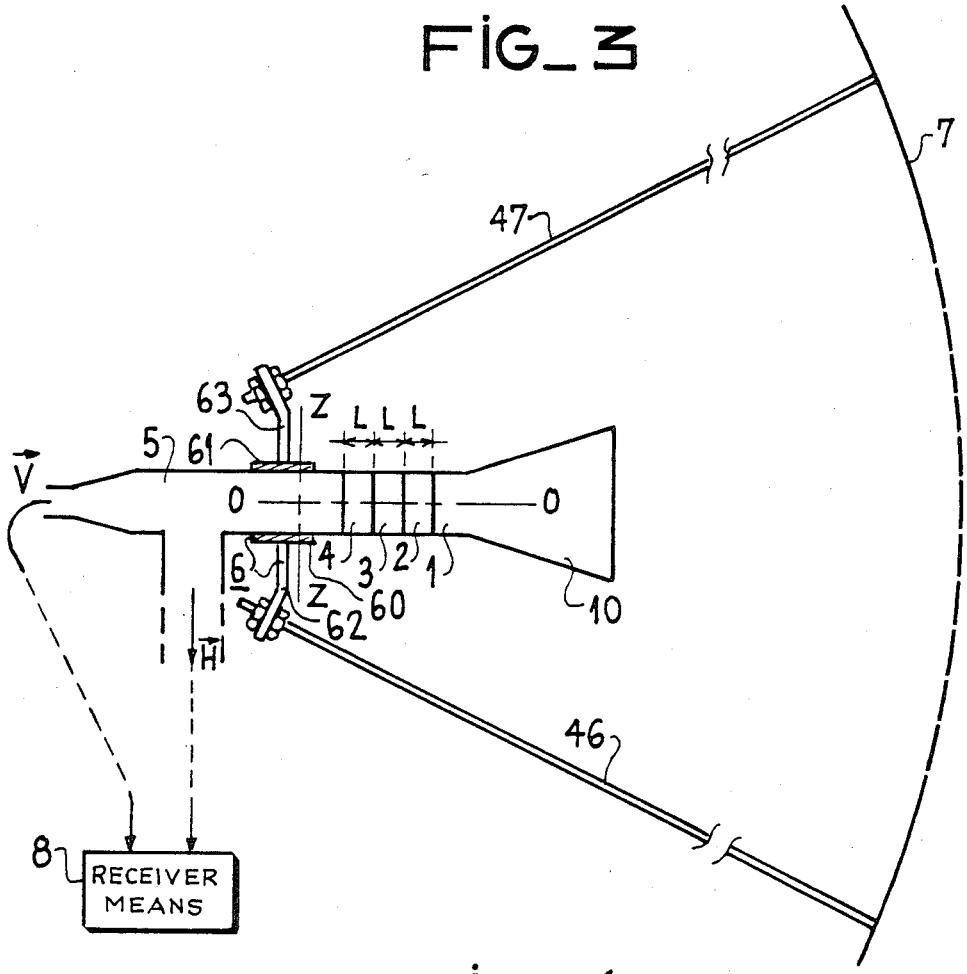
FIG. 3, an antenna in accordance with the invention.

FIG. 3 is a schematical view of a prime focus antenna equipped with a device for transposing the direction of the linear polarization of the waves received by receiving means 8 associated with this antenna. The antenna comprises a reflector 7 and a primary source; this primary source is formed in series by a horn 10 followed by a square cross-section, twisted waveguide, which may be adjustable in steps, 1,2,3,4 followed by a polarizing duplexer 5 whose two accesses V and H are connected to the receiving means 8 by rectangular guides shown schematically in the figure by broken lines.

A securing system 6 connects firmly together the primary source and reflector 7. This securing system comprises four bars, such as bars 46 and 47 which are shown in FIG. 3; these bars are welded, at their first end to reflector 7. The securing system 6 also comprises a positioning assembly, 60 to 67, to which the securing bars are bolted, at their second end. This securing system comprises two half collars 60–61 integral with brackets such as 62–63 to which the securing bars are bolted. In FIG. 3, the securing system is shown in section so as to show the primary source of the antenna.

Figure 4:
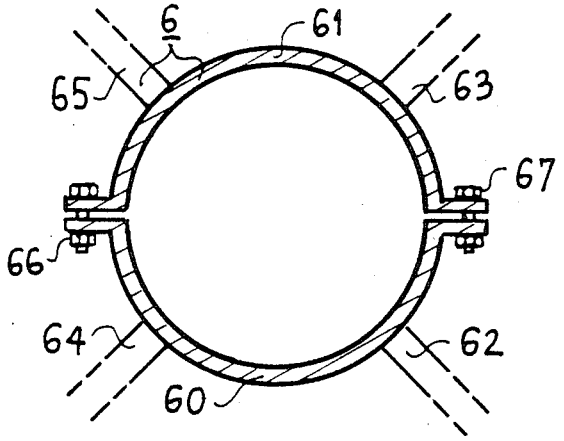
FIGS. 4 to 6, partial enlarged views of the antenna of FIG. 3.

FIG. 4 is a partial view of the securing system 6 of FIG. 1; this view is a sectional view through a plane perpendicular to the plane of FIG. 3 and passing through the straight line ZZ of this figure. FIG. 4 shows the two half collars 60–61 and screw-nut assemblies, such as 66 and 67, which clamp together the two half collars so as to hold the polarizing duplexer 5 of FIG. 3 firmly in position.

In FIG. 4 are also shown the four brackets 62 to 65 of the securing system 6; two of these brackets 62,64 are welded to half collar 60 and the other two 63,65 are welded to half collar 61.

Figure 5:
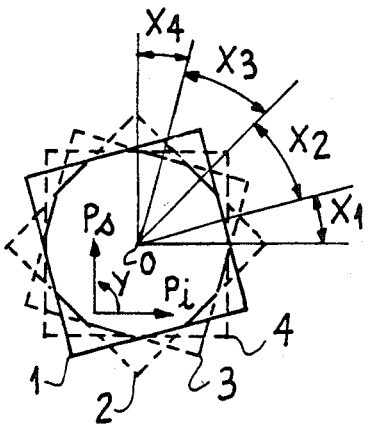
Figure 6:
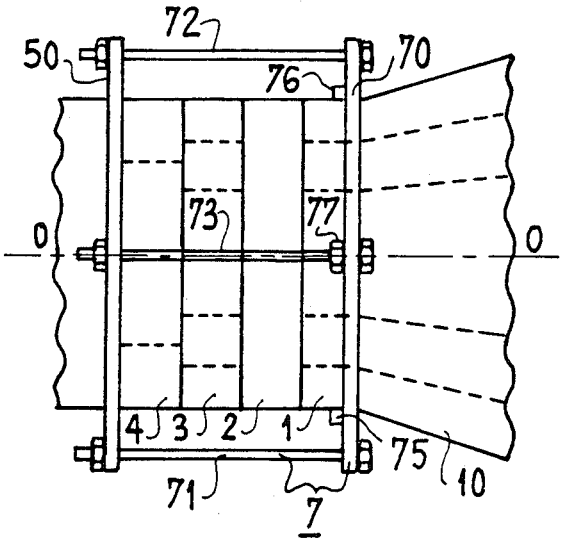

FIG. 5 is a view of the square cross-section, twisted waveguide, adjustable in steps, 1,2,3,4 as seen through the opening of horn 10 of FIG. 3. It will be noted that the first step 1 of this square cross-section, twisted waveguide is integral with horn 10 of FIG. 3 and that its angular position about the main axis 00 (FIG. 1) of the twisted waveguide is adjustable as well as that of the other three steps 2,3,4 of this guide; a securing assembly 7, which is shown in FIG. 6 and will be described with reference to this figure, holds the steps in the position set by this adjustment.

In FIG. 5, a vector $P_i$ indicates the direction of the vertical polarization of a wave with two orthogonal polarizations received by antenna 10 (FIG. 1) while a vector $P_s$ indicates the direction which this polarization must have when the wave reaches the polarizing duplexer 5 (FIG. 3) for the receiving means 8 (FIG. 3) to receive this wave with maximum energy; these two vectors form therebetween an angle Y. As shown in FIG. 5, the twisted waveguide, adjustable in steps, is a square section guide; this square section allows simultaneous transposition of the directions of the two field vectors of the orthogonal polarization wave received.

To effect the transposition of angle Y, steps 1,2,3,4 of the twisted waveguide are rotated:

for the first step 1 by an angle $X_1$ with respect to the position which this step would have if no transposition were necessary, for the other three steps 2,3,4 respectively by angles $X_2$, $X_3$, $X_4$ with respect to the position of the preceding step 1,2,3.

For the sake of clarity of the drawing, so as not to have angles $X_1$ to $X_4$ too small, angle Y has been taken equal to 90°, since Y may assume all the values between 0° and 90°.

The operating principle of a square cross-section twisted waveguide, adjustable in steps is known. It is a matter of a junction, formed from a succession of waveguide sections, which serves for modifying the angle of the electric field leaving this component with respect to the angle of the electric field returning to this component. This modification takes place by steps of a length L given by the distance L (FIG. 3), between two transitions of this twisted waveguide and this length L is chosen equal to $\lambda g/K$ where $\lambda_g$ is the guided wavelength of the mean operating frequency of the twisted waveguide, i.e. 11.7 GHz in the example described, where K is the number of steps, namely four in the present case. This junction formed by the twisted waveguide introduces a reflection coefficient which depends on the number K of the steps, on the angle given to each step ($X_i$), on the working frequency and on the cut-off frequency of the waveguide.

Figure 7:
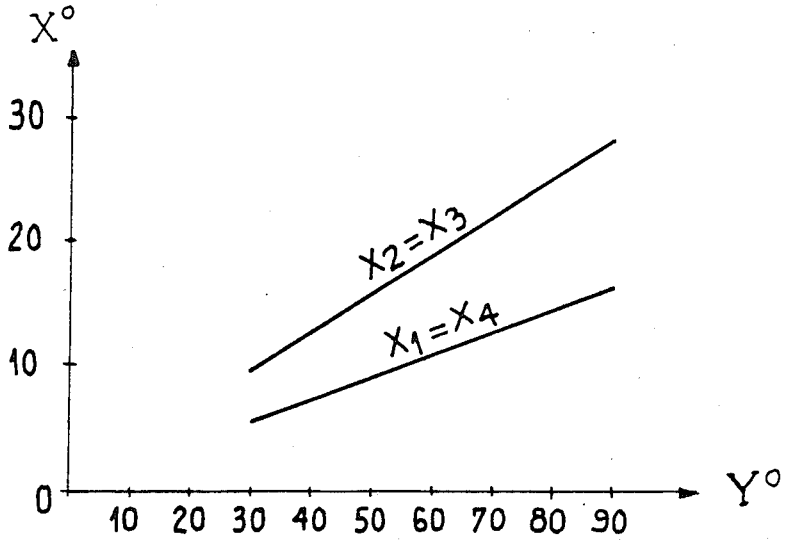
FIG. 7, a curve relative to adjustment of the antenna of FIG. 3.

To have the minimum reflection coefficient, the angle $X_i$ of each step of the step twist guide is conventionally determined in accordance with the so-called Maximally flat binomial law. The results of this study are given for the case of four steps in FIG. 7; this FIG. 7 shows for example that, to obtain transposition of the direction of polarization Y by 90°, the angles $X_1$ and $X_4$ (FIG. 5) must have a value of 16.5° whereas the angles $X_2$ and $X_3$ (FIG. 5) must have a value of 28.5°.

FIG. 6 is a partial view of the antenna of FIG. 3 at the level of the twisted waveguide, adjustable in steps; in this figure is shown an assembly 7 which was not shown in FIG. 3 for the sake of clarity. This assembly comprises a ring 70, four stops three of which 75, 76, 77 are shown in FIG. 6, four screw-nut assemblies three of which 71, 72 or 73 are shown in FIG. 6 and a collar 50 integral with the wave-guide which forms the axis of the polarizing duplexer 5. The screw-nut assemblies, such as 71, connect the ring 70 to collar 50; without the screw-nut assemblies ring 70 may rotate freely about step 1 of the twisted waveguide but cannot be removed for it is locked on one side by the base of horn 10 and on the other by the stops such as 75 which are screwed into the outer wall of step 1. To adjust the angular position of the four steps of the twisted waveguide, the four screw-nut assemblies are first of all loosened, then the adjustment is carried out by means of graduations and marks not shown in the figure, then the screw-nut assemblies are screwed up tight again.

The invention is not limited to the example described with reference to FIGS. 3 to 6; thus for example the control of the angular position of the steps may be effected by means of motors. Furthermore, in the case where the wave received only comprises a single rectilinear polarization, the polarizing duplexer 5 of FIG. 3 does not need to be there and the section of the steps of the step twist guide will not be square but rectangular. Similarly, the step twist guide may comprise a number of steps different from four, for example, 2, 3, 4, 6 etc. . . or else this step twist guide may be replaced by a twist guide, but in this latter case the twist guide will have to be changed for each modification of the transposition angle setting which will require a set of twist guides to be provided in this case.

Of course, the invention is not limited to the use of the device in an antenna operating in the reception mode since, because of the principle of reversability of electro-magnetic waves, the device may also operate in the transmission mode.

What is claimed is:

1. An antenna for working with linearly polarized waves, comprising:

a primary source including, in series:

means defining an aperture;

a transposition device, capable of transposing the direction of two orthogonal polarizations of the waves passing therethrough, and formed from a square cross-section twisted waveguide which is adjustable in steps; and a waveguide element;

a reflector placed opposite said aperture means;

means, connected to said waveguide element, for securing said reflector to said primary source; and means for locking said transposition device in a position in which it has been adjusted.

* * * * *